US007568552B2

(12) United States Patent
Litovsky et al.

(10) Patent No.: US 7,568,552 B2
(45) Date of Patent: Aug. 4, 2009

(54) ACOUSTIC PASSIVE RADIATOR ROCKING MODE REDUCING

(75) Inventors: Roman Litovsky, Newton, MA (US); Jingyi Liu, Marlborough, MA (US); Roger Mark, Barrington, RI (US); Nachiketa Tiwari, Mansfield, MA (US)

(73) Assignee: Bose Corporation, Framingham, MA (US)

( * ) Notice: Subject to any disclaimer, the term of this patent is extended or adjusted under 35 U.S.C. 154(b) by 842 days.

(21) Appl. No.: 10/758,336

(22) Filed: Jan. 15, 2004

(65) Prior Publication Data

US 2005/0157900 A1 Jul. 21, 2005

(51) Int. Cl.

| | |
|---|---|
| ***G10K 13/00*** | (2006.01) |
| ***H04R 7/20*** | (2006.01) |
| *H04R 7/18* | (2006.01) |
| *H04R 7/16* | (2006.01) |

(52) U.S. Cl. ..... 181/171; 181/172; 181/174; 381/424

(58) Field of Classification Search ..... 181/171–174, 181/156; 381/392, 423, 424

See application file for complete search history.

(56) References Cited

U.S. PATENT DOCUMENTS

| | | | | | |
|---|---|---|---|---|---|
| 727,634 | A | * | 5/1903 | Hutchison | |
| 1,742,016 | A | * | 12/1929 | Staunton | 181/172 |
| 1,757,345 | A | | 5/1930 | Newton | |
| 1,832,832 | A | * | 11/1931 | Nagelvoort | 181/174 |
| 2,713,396 | A | | 7/1955 | Tavares | |
| 3,424,873 | A | * | 1/1969 | Walsh | 381/346 |
| 3,780,824 | A | | 12/1973 | Prince | |
| 4,132,872 | A | | 1/1979 | Inoue | |
| 4,163,876 | A | * | 8/1979 | Ohnuki | 381/347 |
| 4,169,516 | A | * | 10/1979 | Honda | 181/153 |
| 4,207,963 | A | | 6/1980 | Klasco | |
| 4,379,951 | A | * | 4/1983 | Gabr | 381/431 |
| 4,478,309 | A | * | 10/1984 | Kawamura et al. | 181/167 |
| 4,817,165 | A | * | 3/1989 | Amalaha | 381/425 |
| 5,418,337 | A | * | 5/1995 | Schreiber | 181/171 |
| 5,599,563 | A | | 2/1997 | Yocum | |
| 5,650,105 | A | | 7/1997 | Yocum | |
| 5,740,264 | A | * | 4/1998 | Kojima | 181/171 |
| 5,862,242 | A | * | 1/1999 | Takewa et al. | 381/398 |
| 5,892,184 | A | * | 4/1999 | D'Hoogh | 181/171 |
| 6,044,925 | A | | 4/2000 | Sahyoun | |
| 6,095,280 | A | | 8/2000 | Proni et al. | |
| 6,176,345 | B1 | | 1/2001 | Perkins | |
| 6,237,716 | B1 | * | 5/2001 | Peng | 181/171 |

(Continued)

FOREIGN PATENT DOCUMENTS

| | | |
|---|---|---|
| DE | 38 31 376 | 3/1990 |

(Continued)

*Primary Examiner*—Edgardo San Martin

(57) ABSTRACT

An acoustic passive radiator that controls "rocking mode" vibration. An acoustic passive radiator includes a diaphragm for radiating acoustic energy. The diaphragm has a perimeter portion and a central portion. The perimeter portion is thicker than the central portion. The passive radiator further includes a passive radiator suspension. The suspension includes a skin element encasing the diaphragm. The skin element comprises a surround for physically coupling the passive radiator to an acoustic enclosure, pneumatically sealing the diaphragm and the enclosure. The surround has a non-uniform width. The passive radiator a non-pneumatically sealing, non-surround, non-spider suspension element. The non-surround suspension element and the surround coact to control the motion of the diaphragm and to support the weight of the diaphragm.

16 Claims, 9 Drawing Sheets

U.S. PATENT DOCUMENTS

| | | | | |
|---|---|---|---|---|
| 6,305,491 | B2 * | 10/2001 | Iwasa et al. | 181/172 |
| 6,385,327 | B1 | 5/2002 | D'Hoogh | |
| 6,396,936 | B1 | 5/2002 | Nevill | |
| 6,418,231 | B1 * | 7/2002 | Carver | 181/199 |
| 6,460,651 | B1 | 10/2002 | Sahyoun | |
| 6,577,742 | B1 | 6/2003 | Bruney | |
| 6,607,051 | B1 * | 8/2003 | Peng | 181/171 |
| 6,626,263 | B2 | 9/2003 | Sahyoun | |
| 6,658,129 | B2 | 12/2003 | D'Hoogh | |
| 6,675,931 | B2 * | 1/2004 | Sahyoun | 181/157 |
| 6,862,361 | B2 * | 3/2005 | Clark et al. | 381/423 |
| 7,151,836 | B1 * | 12/2006 | Funahashi et al. | 381/150 |
| 2002/0121403 | A1 | 9/2002 | Sahyoun | |
| 2003/0015369 | A1 | 1/2003 | Sahyoun | |
| 2005/0078849 | A1 * | 4/2005 | Funahashi et al. | 381/412 |
| 2005/0157900 | A1 | 7/2005 | Litovsky et al. | |
| 2005/0194203 | A1 * | 9/2005 | Muto et al. | 181/172 |
| 2006/0137935 | A1 * | 6/2006 | Nevill | 181/174 |

FOREIGN PATENT DOCUMENTS

| | | | | |
|---|---|---|---|---|
| DE | 3831376 | A1 * | 3/1990 | |
| DE | 4213991 | A1 * | 11/1993 | |
| EP | 0 529 143 | | 3/1993 | |
| EP | 0 548 836 | B1 * | 6/1997 | |
| EP | 1555849 | | 7/2005 | |
| JP | 56013896 | A * | 2/1981 | |
| JP | 57054498 | A * | 3/1982 | |
| JP | 58 138196 | | 8/1983 | |
| JP | 58151797 | A * | 9/1983 | |
| JP | 61103393 | A * | 5/1986 | |
| JP | 01272300 | A * | 10/1989 | |
| JP | 2005-204320 | | 7/2005 | |
| WO | WO 98/02016 | | 1/1998 | |
| WO | WO 99/04597 | | 1/1999 | |

* cited by examiner

ACOUSTIC PASSIVE RADIATOR ROCKING MODE REDUCING

BACKGROUND

The invention relates to acoustic passive radiators, and more particularly to reducing rocking mode vibration.

It is an important object of the invention to provide an acoustic passive radiator with reduce rocking mode vibration.

SUMMARY

According to the invention, an acoustic passive radiator includes a diaphragm for radiating acoustic energy. The diaphragm has a perimeter portion and a central portion. The perimeter portion is thicker than the central portion. The passive radiator further includes a passive radiator suspension. The suspension includes a skin element encasing the diaphragm. The skin element comprises a surround for physically coupling the passive radiator to an acoustic enclosure and pneumatically sealing the diaphragm and the enclosure. The surround has a non-uniform width. The passive radiator has a non-pneumatically sealing, non-surround, non-spider suspension element. The non-surround suspension element and the surround coact to control the motion of the diaphragm and to support the weight of the diaphragm.

In another aspect of the invention, a diaphragm for an acoustic passive radiator is constructed and arranged to have a moment of inertia that is greater than a diaphragm of equivalent mass that is constructed of a homogeneous material and having a uniform thickness.

In another aspect of the invention, an acoustic passive radiator includes a diaphragm for radiating acoustic energy; a surround for pneumatically sealing the diaphragm and an acoustic enclosure; and a plurality of discrete, non-surround, non-spider suspension elements for physically coupling the diaphragm and the acoustic enclosure. The non-surround suspension elements and the surround coact to control the motion of the diaphragm and to support the weight of the diaphragm.

In another aspect of the invention, an acoustic passive radiator includes a diaphragm for radiating acoustic energy and a surround for pneumatically sealing the diaphragm and an acoustic enclosure. The surround is constructed of a solid polyurethane.

In another aspect of the invention, an acoustic passive radiator includes a diaphragm for radiating acoustic energy and a surround for pneumatically sealing the diaphragm and an acoustic enclosure. The surround has a non-uniform width.

In another aspect of the invention, an acoustic passive radiator includes a mass element and a skin element enclosing a portion of the mass element so that the skin element is attached to the mass element without adhesive. The skin element includes a surround for mechanically supporting the mass element and for providing a surface for attaching the acoustic passive radiator to an acoustic enclosure.

In still another aspect of the invention, a method for forming a passive acoustic radiator includes placing a mass element into a cavity in a mold. The cavity defines a shape of a passive acoustic radiator suspension. The method further includes inserting a flowable material into the cavity so that the flowable material fills the cavity and causing the material to set to a firm elastomeric state.

Other features, objects, and advantages will become apparent from the following detailed description, when read in connection with the accompanying drawing in which:

DETAILED DESCRIPTION

Figure 1A:
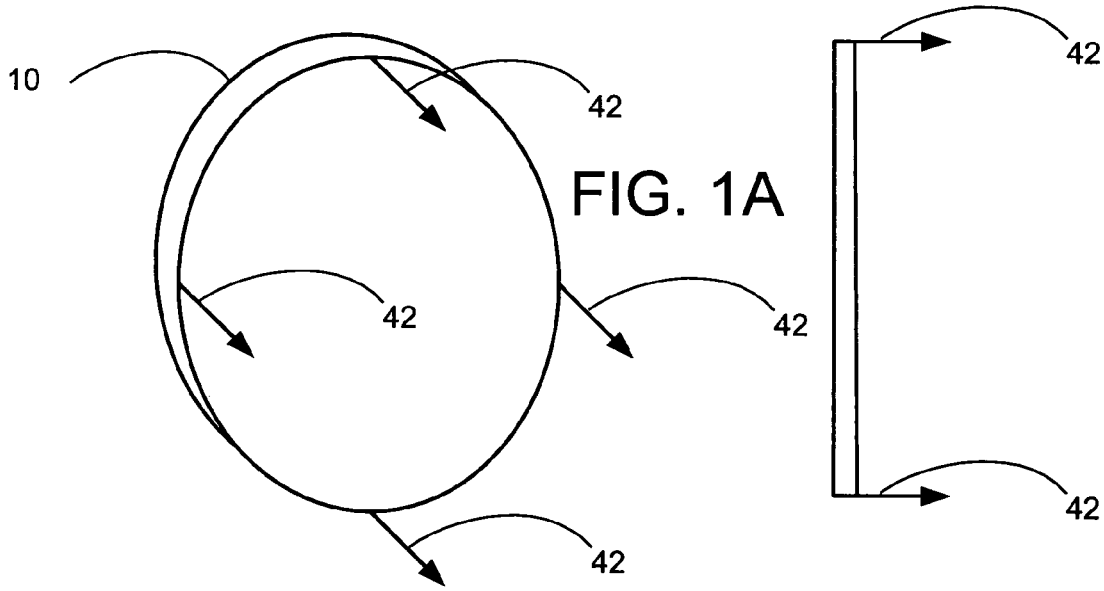
FIGS. 1A and 1B are diagrammatic isometric views of a passive radiator diaphragm for illustrating some terms used in the specification.
Figure 1B:
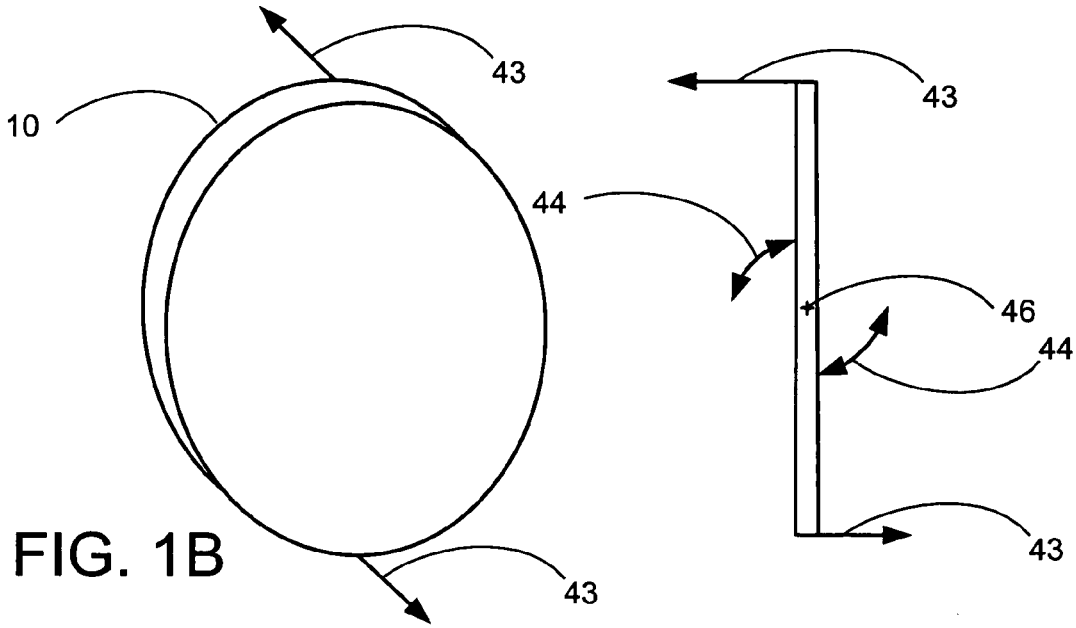

With reference now to the drawings and more particularly to FIGS. 1A and 1B, there are shown views of a passive acoustic radiator diaphragm for illustrating some terms used in the specification. A passive acoustic radiator (sometimes referred to as a "drone") typically includes a diaphragm 10 that is mounted in an acoustic enclosure (not shown) by a suspension system (not shown). An acoustic driver radiates acoustic energy into the acoustic enclosure, causing pressure variations in the enclosure. The passive radiator diaphragm 10 vibrates, responsive to the pressure variations in the enclosure. In one common form of passive radiator, the diaphragm and the suspension are designed so that the diaphragm moves pistonically. In pistonic motion, all points on the diaphragm move uniformly along an intended axis of motion, as indicated by velocity vectors 42, and the points of the diaphragm do not move relative to each other. However, in some circumstances (such as the presence of lateral forces, uneven pressure or acoustic loading across the radiating surface, or suspension nonlinearities) points on the radiating surface may move nonuniformly along the intended axis of motion, so that points of the diaphragm move relative to each other and indicated by velocity vectors 43 which results in vibratory rotational motion as indicated by arrows 44 about an axis 46. Non-pistonic motion of the type shown in FIG. 1B is sometimes referred to as "rocking mode" vibration and the axis 46 is referred to as the rocking axis. Rocking mode vibration has undesirable acoustic effects, such as loss of acoustic efficiency or distortion of the sound radiated by the passive radiator. Rocking mode vibration tends to occur at specific frequencies that are related to characteristics of the diaphragm, the suspension, and the acoustic enclosure, the placement and the mechanical and acoustic characteristics of the acoustic driver, and other factors. Some practices or devices that can alleviate rocking mode vibration, for example multiple surrounds, "spiders," and other suspension elements, and symmetric placement of acoustic drivers relative to passive radiators, are difficult to implement in some types of loudspeaker units, such as compact low frequency woofer or subwoofer loudspeaker units.

The type of rocking mode vibration described above is the most commonly observed form of rocking mode. The devices and techniques disclosed herein generally act to prevent or control other, more complex, forms of rocking mode. For simplicity of explanation, the devices and techniques will be described relative to the type of rocking mode described above.

The discussion above also relates to motion of a rigid diaphragm. Other modes, many of which have undesirable acoustic effects, may occur if the diaphragm is not rigid. "Buckling modes" and "potato chip" modes are examples of modes of non-rigid diaphragms that have undesirable acoustic effects. The devices and techniques disclosed herein may act to prevent or control undesirable non-rigid modes. For simplicity of explanation, the devices and techniques will be described as they relate to rocking mode vibration of a rigid diaphragm.

Figures 2A, 2B:
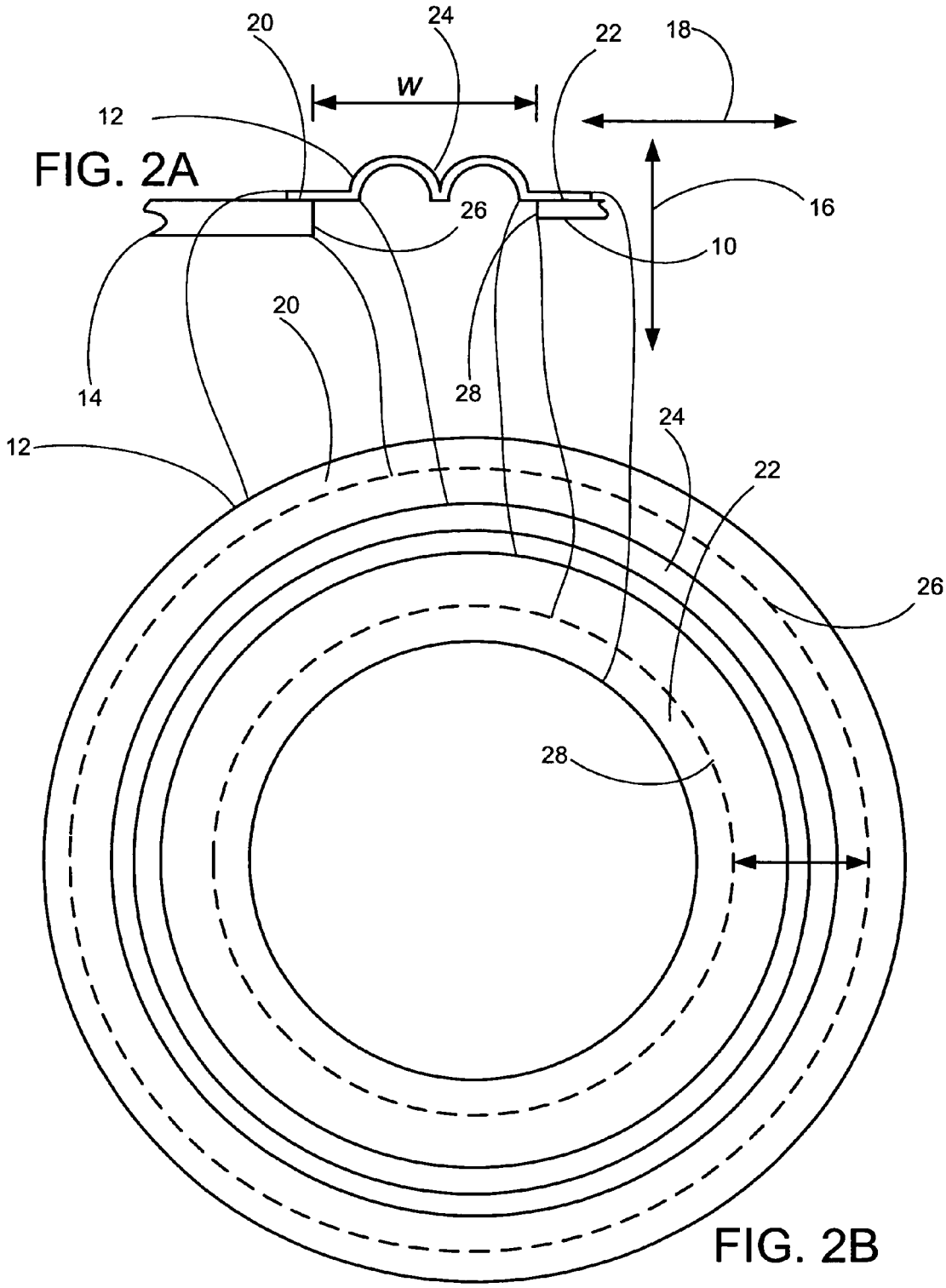
FIGS. 2A and 2B are views of an acoustic enclosure, a surround type suspension, and a passive radiator diaphragm for illustrating terms used in the specification.

Referring now to FIG. 2A, there is shown a cross-sectional view of a portion of an acoustic enclosure, a surround type suspension, and a passive radiator diaphragm 10 for illustrating terms used in the specification. For convenience, the passive radiator diaphragm is shown as a planar element, but can take many forms, such as a cone shaped structure, or a structure with one or more non-planar surfaces. A suspension system that includes a surround 12 mechanically couples a passive radiator diaphragm 10 to an acoustic enclosure element 14 or some other structure. The diaphragm is typically mounted in an opening in acoustic enclosure element 14. The surround is designed so that the passive radiator diaphragm can vibrate in a direction indicated by arrow 16, and so that motion in directions transverse to direction 16, such as indicated by arrow 18 is inhibited. In addition to controlling the motion of the passive radiator diaphragm 10, the suspension supports the weight of the passive radiator diaphragm 10 and seals the passive radiator diaphragm and the enclosure element so that air cannot leak from one side of the enclosure element and diaphragm to the other through the opening in the enclosure element 14. To facilitate attaching the surround to the acoustic enclosure element 14, the surround may have an outer attachment area 20, and the enclosure element may have a frame structure (not shown). The surround may have a passive radiator attachment area 22 to facilitate attaching the surround to the passive radiator diaphragm 10. The surround has a roll area 24 that is formed into a geometry that facilitates motion in direction 16. A so called "double roll" configuration is shown, but several other configurations, such as single roll, corrugations, opposed rolls, and the like may be used.

FIG. 2B is a top plan view of the assembly of FIG. 2A, with the edge 26 of the enclosure element 14 and the edge 28 of the passive radiator diaphragm 10 indicated in dashed lines. Additionally, reference lines indicate correspondence between various points of the surround 12 in the two views. The surround is attached to the acoustic enclosure element 14 along outer attachment area 20 and to the passive radiator diaphragm 10 along passive radiator attachment area 22. Attachment is typically by an adhesive or some other fastening element or method. Ideally, the acoustic enclosure element and the passive radiator diaphragm are attached along attachment areas 20 and 22 in an air tight manner, so that air cannot leak from one side of the surround to the other. The "width" of the surround, as used herein, is the length w of unattached surround between the enclosure element 14 and the passive radiator diaphragm.

Figure 3A:
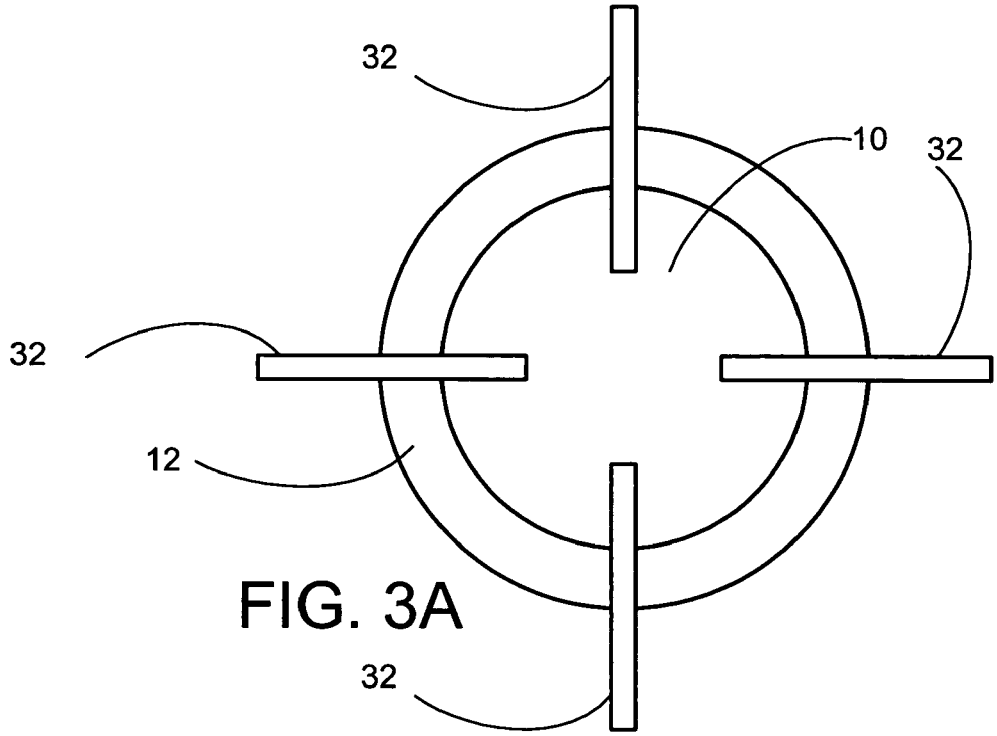
FIGS. 3A-3E are views of an enclosure element, a passive radiator diaphragm, and a passive radiator suspension assembly according to one aspect of the invention.
Figure 3B:
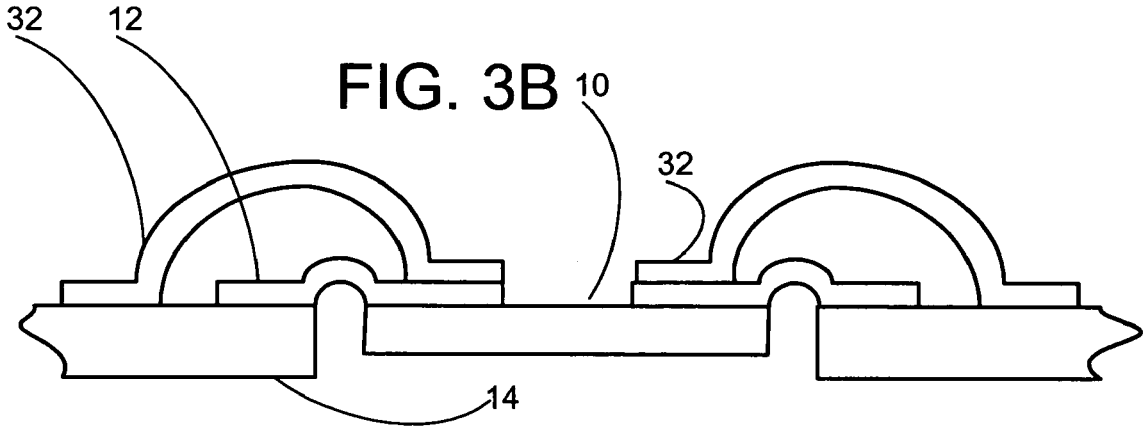

Referring to FIGS. 3A and 3B, there are shown a top plan view and a cross sectional view of an enclosure element 14 a passive radiator diaphragm 10, and a passive radiator suspension assembly according to one aspect of the invention. The suspension assembly includes a surround 12, similar to the surrounds of previous views. In addition to the surround 12, the suspension assembly includes two or more discrete non-surround suspension elements 32, for example flexures. The discrete suspension elements may be attached to the diaphragm at any convenient point (which may be in the attachment area 22, as shown). The suspension assembly performs the same functions (controlling direction of motion, supporting the weight of the diaphragm, and pneumatically sealing the acoustic enclosure element and the passive radiator diaphragm) as the suspensions of previous views. The surround provides the pneumatic sealing, while the weight supporting and the motion control are provided by the combination of the surround and the non-surround suspension elements.

Use of materials that have good stiffness, good internal damping, and that are thermally stable help to reduce or control rocking modes. In addition to good stiffness, good internal damping, and thermal stability, materials should have other qualities that are desirable for surround material, such as linearity and ease of bonding. For use in small enclosures, thermal stability is especially important. Solid polyurethanes, which have an elastic modulus in the range of $1.4\times10^7$ newtons/sq. meter, a tan delta of 0.1, good thermal stability, good linearity, and good bondability, are suitable.

In one embodiment of the configuration of FIGS. 3A and 3B, passive radiator diaphragm 10 is a planar aluminum disk with a diameter of about 12.5 inches (31.75 cm) and a thickness of about 0.5 inches (1.27 cm). The surround is a single roll surround of polyurethane foam 0.05 inches (1.27 mm) thick and 0.8 inches (2.03 cm) wide. The non-surround suspension elements include four bands of spring steel 0.006 inches (0.15 mm) thick 1.2 inches (3.05 cm) wide and 1.2 inches (3.05 cm) long.

Figure 3C:
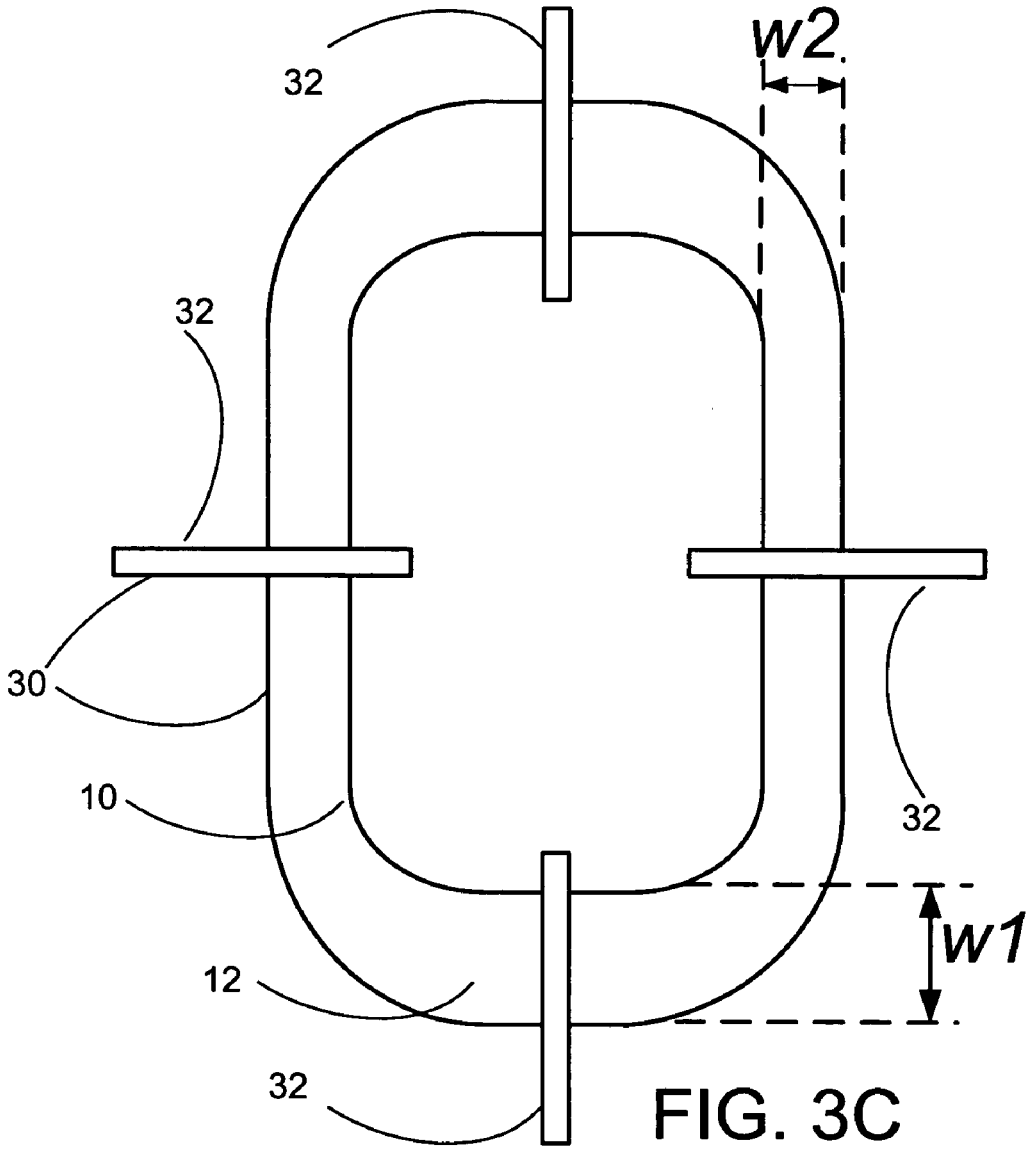

FIG. 3C shows an alternate configuration of the device of FIGS. 3A and 3B. In the configuration of FIG. 3C, the diaphragm 10 has a so-called "racetrack" shape. In other configurations, the diaphragm may have other shapes, such as round or oval, and may take other forms, such as a cone shaped structure. FIG. 3C illustrates another feature of the invention that reduces or controls rocking mode vibration. The surround is wider (and may also be thicker) at locations that are prone to rocking mode vibration. For example, width w1 may be greater than width w2.

Figure 3D:
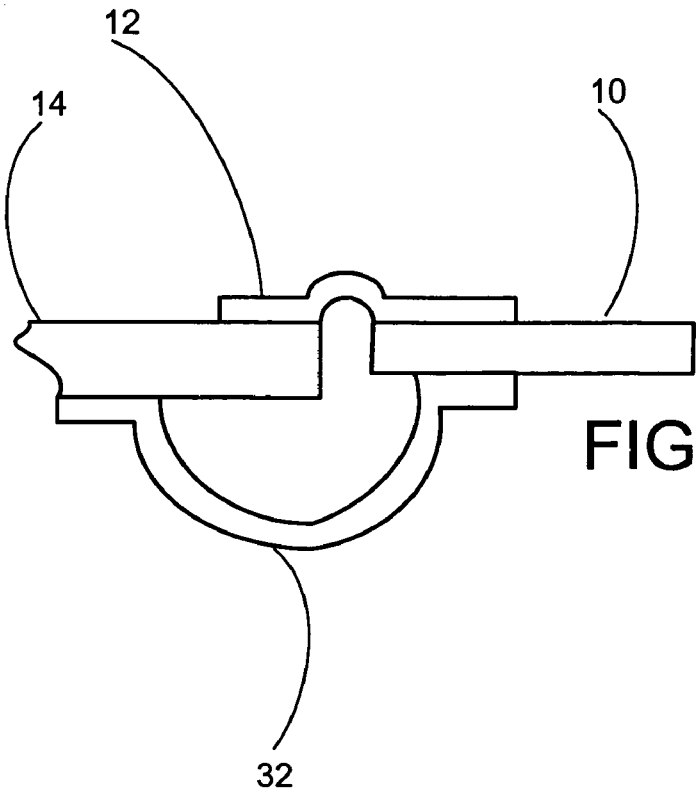
Figure 3E:
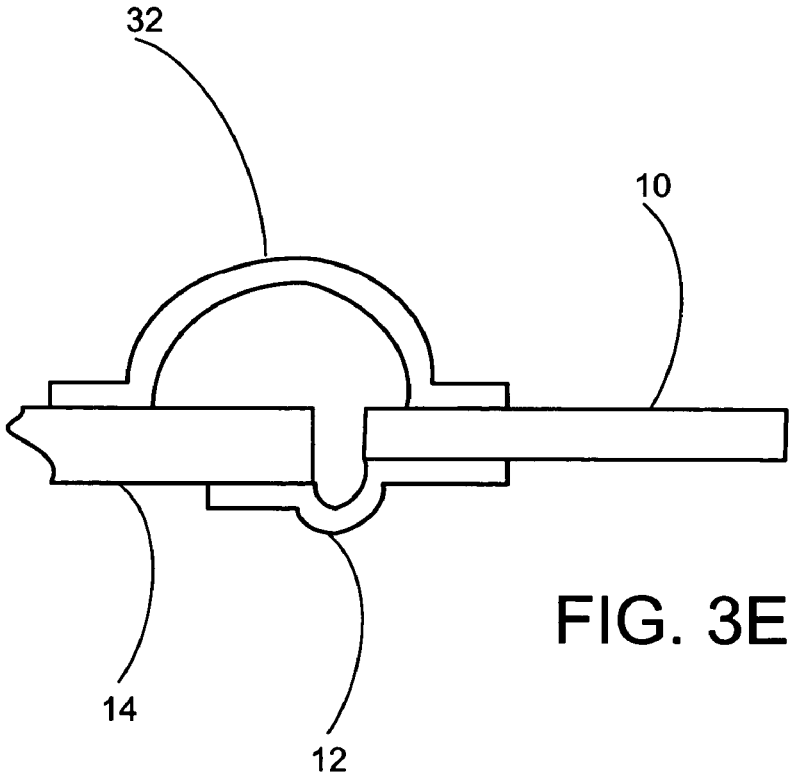

FIGS. 3D and 3E show alternate arrangements of the surround 12 and the discrete non-surround suspension elements 32. The discrete non-surround suspension elements 32 and the surround may be mounted to the diaphragm 10 on the same side, as in FIG. 3A or on opposite sides, as shown in FIGS. 3D and 3E.

A passive radiator suspension according to FIGS. 3A-3E is advantageous over conventional passive radiator suspensions because the non-surround suspension elements permits sharing of the weight support function between the surround and the non-surround suspension elements. This provides great design flexibility and allows the use of heavy diaphragms without requiring spiders or complex bulky surrounds that may limit the motion of the diaphragm or take up more space than desired, or both. The non-surround suspension elements can be placed at positions that are more likely than other positions to be prone to be subject to conditions that cause rocking mode vibration, for example at positions on the diaphragm that are subject to greater stress because of geometry, or where there are pressure differences across the diaphragm. The suspension system can be more easily designed so that a loudspeaker incorporating the invention can be oriented so that the intended direction of motion of the passive radiator is either horizontal (so that gravity is a force that is lateral to the direction of motion of the diaphragm) or vertical (so that gravity is a force that is parallel to the direction of motion of the diaphragm). Additionally, the passive radiator suspension may be made more resistant to drift or creep, so that it maintains its characteristics over time. Still further, the suspension may be made less susceptible to deformation of the surround due to pneumatic pressure.

Figure 4A:
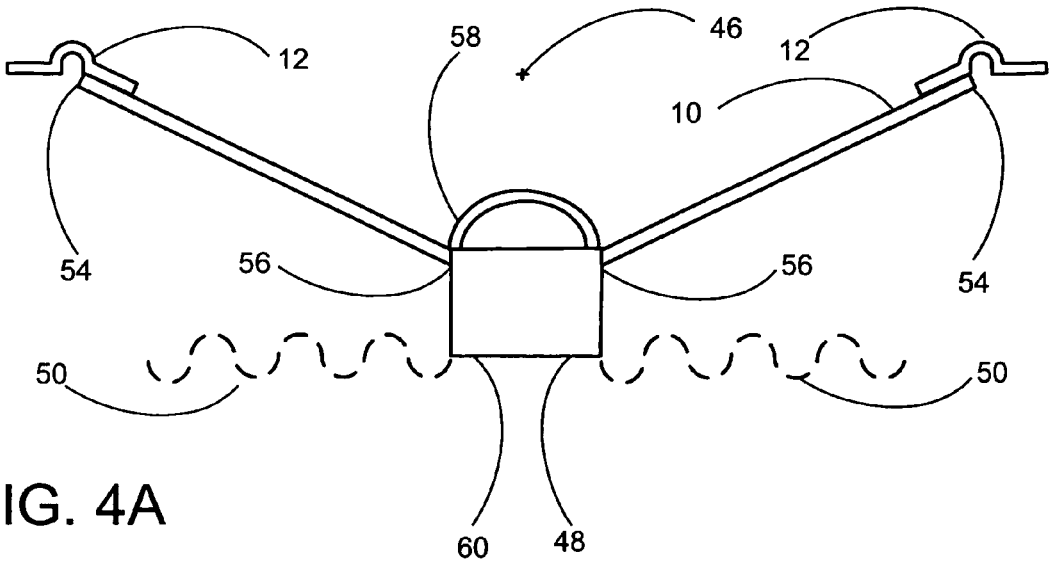
FIGS. 4A-4C are views of passive radiator diaphragms according to another aspect of the invention.
Figure 4B:
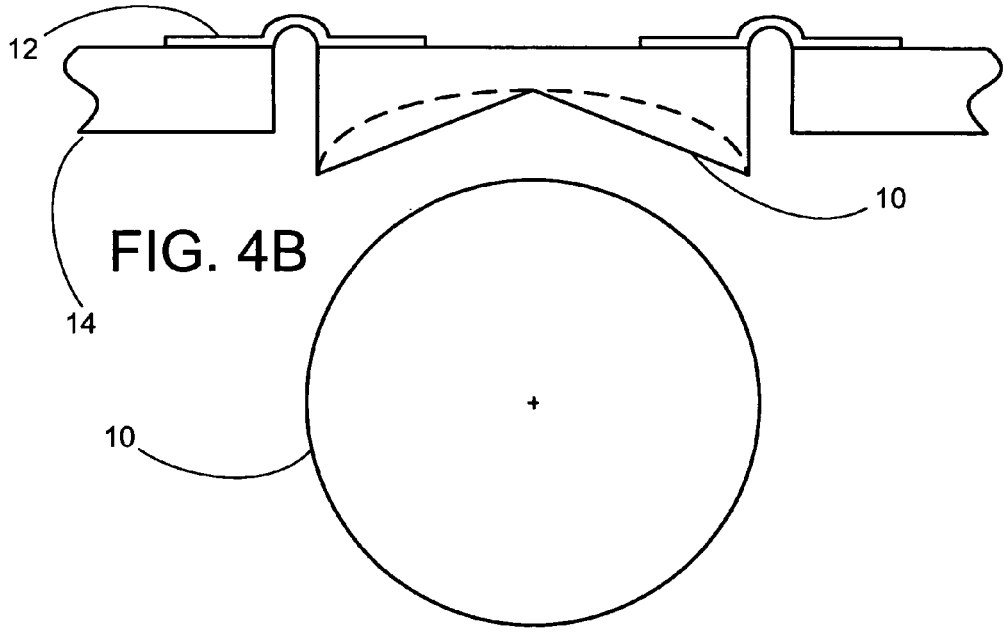
Figure 4C:
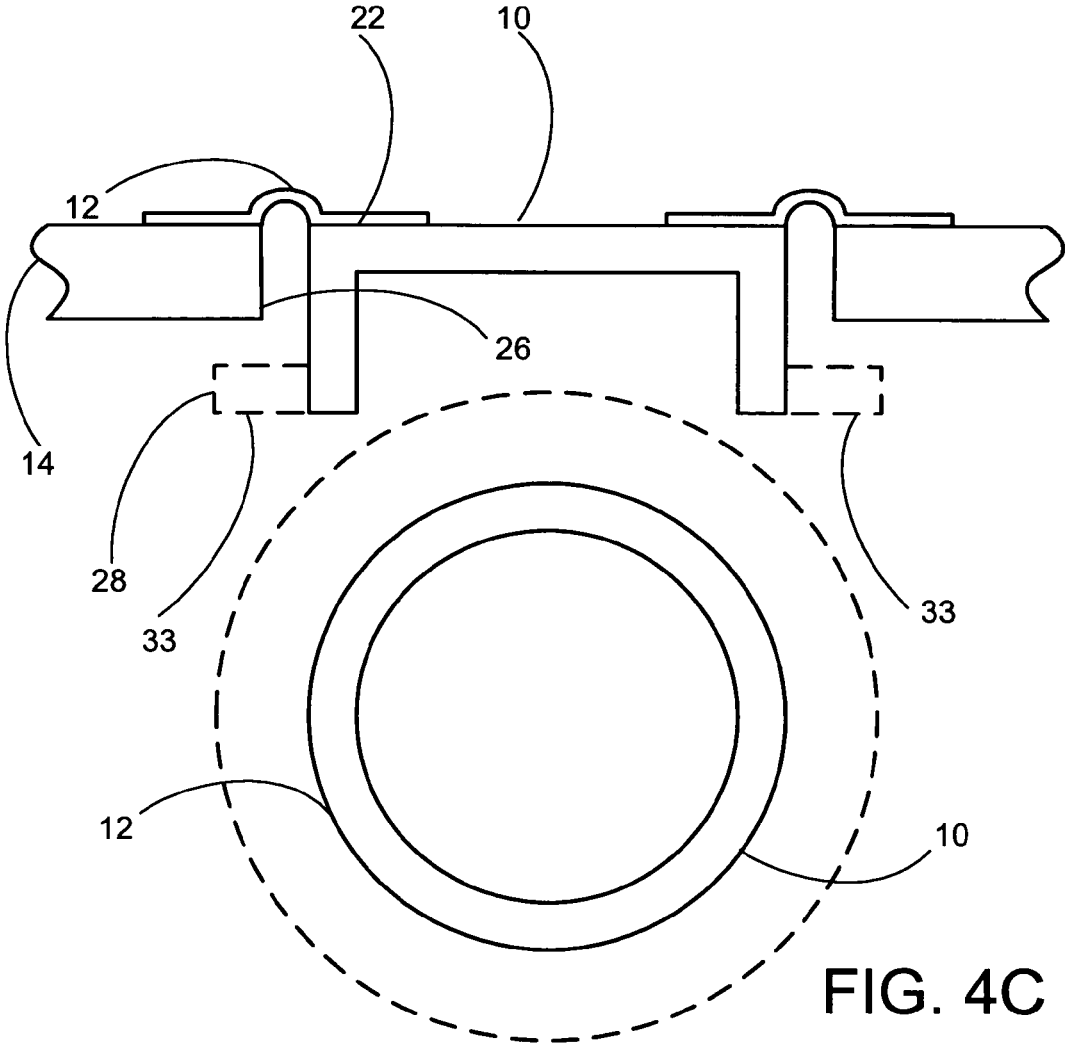

Referring to FIG. 4A-4C, there is shown cross-sectional and plan views of some passive radiator diaphragm designs that control rocking mode vibration. One method of controlling rocking mode vibration is to control mass distribution of the diaphragm. Generally, moving mass away from the axis of rotation for any rotational motion of the diaphragm increases the moment of inertia and causes rocking mode vibration to occur at lower frequencies. Moving mass toward the axis of rotation decreases the moment of inertia and causes rocking mode vibration to occur at higher frequencies. By distributing mass properly, it is possible to cause the rocking mode vibration frequencies to be below or above the operating frequency of the passive radiator. The lower rocking mode frequencies are typically of greater interest, because passive radiators are typically used to augment bass acoustic radiation, and the audio signals sent to loudspeakers employing passive radiators are often low-pass filtered to remove high frequency spectral components. In FIG. 4A, the diaphragm has the form of a frustoconical surface attached to a surround at the outer edge 54 of the diaphragm and an additional mass 48 attached to the inner edge 56 of the diaphragm, so that the mass is displaced from the rocking axis 46. One method for forming an implementation of FIG. 4A is to use a conventional acoustic driver cone and dust cover 58 for the diaphragm, attaching a tube 60, for example a coil former, or similar element, in a conventional way. Additionally, material may be placed inside the tube so that the additional mass includes the tube and the material that may have been deposited inside the tube. Other rocking mode limiting devices, such as a spider 50, may provide additional rocking mode control.

In the embodiment of FIG. 4B, the passive radiator diaphragm is thicker at the perimeter than at the center. The thickness may increase linearly (as shown by the solid line), may increase exponentially (as shown by the dashed line), or may increase in some regular or irregular manner determined experimentally or by computer simulation. FIG. 4C shows another passive radiator diaphragm in which the distribution of mass has been configured to increase (over a uniform thickness diaphragm) the moment of inertia to change a rocking mode frequency. The diaphragm of FIG. 4C has a cup shaped form, with a band or ring of material at the perimeter, increasing the mass at the perimeter. Additionally, the diaphragm may be attached to surround at a point other than the lateral outer extremity of the diaphragm, so that the diaphragm is larger that the opening in which it is mounted. In one configuration the diaphragm has a lateral extension 33 so that the passive radiator diaphragm edge 28 lies outside the edge 26 of the enclosure element 14. The lateral extension 33 is offset from the enclosure opening so that the diaphragm does not strike the enclosure during operation. The passive radiator attachment area 22 lies inside the perimeter of the diaphragm. If the configuration permits, the passive radiator may be configured so that the ring or band of material and the lateral extension is outside the acoustic enclosure.

Figure 5:
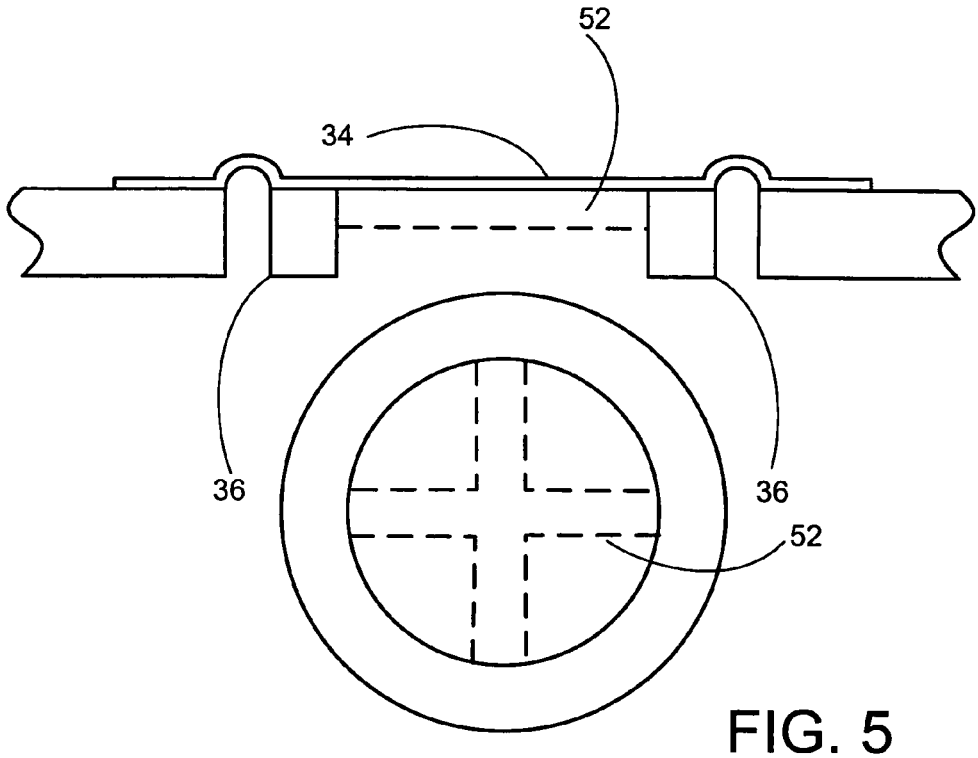
FIG. 5 is a view of a passive radiator according to another aspect of the invention.

Referring now to FIG. 5, there is shown another passive radiator diaphragm according to the invention. In the implementation of FIG. 5, the diaphragm 10 includes a skin element 34 and a mass element 36. The skin element 34 may be a unitary structure with the surround 12 as shown, or may be separate from the surround. If the diaphragm is not sufficiently stiff and exhibits membrane behavior, the mass element may include stiffening elements, such as ribs 52, for example.

An implementation according to FIG. 5 provides even greater flexibility of mass distribution. The mass element 36 may, for example, be a ring shaped structure as shown in FIG. 5, providing great concentration of mass at the perimeter and a significantly higher moment of inertia than conventional passive radiator diaphragms. The mass element 36 may also take the form of the diaphragms of FIGS. 4A-4C, with the additional flexibility that the surface of the mass element 36 need not be unbroken or continuous.

Figure 6:
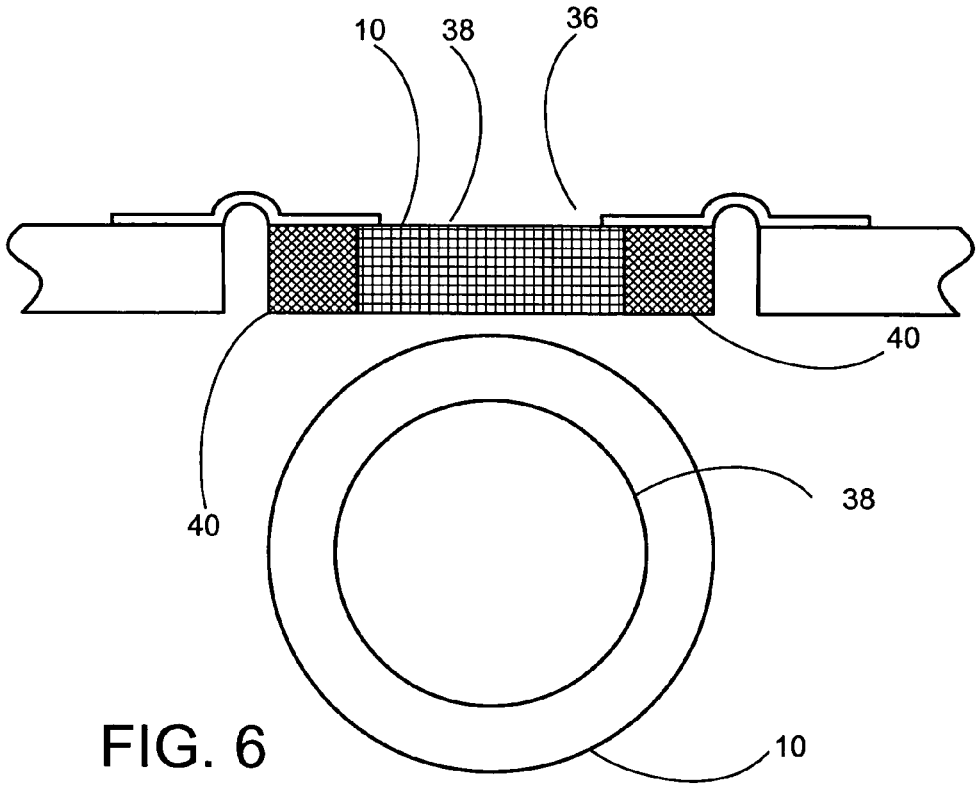
FIG. 6 is a view of a passive radiator according to another aspect of the invention.

Referring now to FIG. 6, there is shown another implementation of the invention. In the implementation of FIG. 6, different sections of the diaphragm 10 or of the mass element 36 are formed of different material. For example, a first inner section 38 may be of a low density material, while an outer section 40 may be of higher density material. Examples of low density materials may include light papers or plastics, foams, or honeycomb structures that are unfilled or filled with low density material, while examples of higher density materials may include heavy papers or plastics, metal, wood, composites, or honeycomb structures filled with higher density material.

Figure 7:
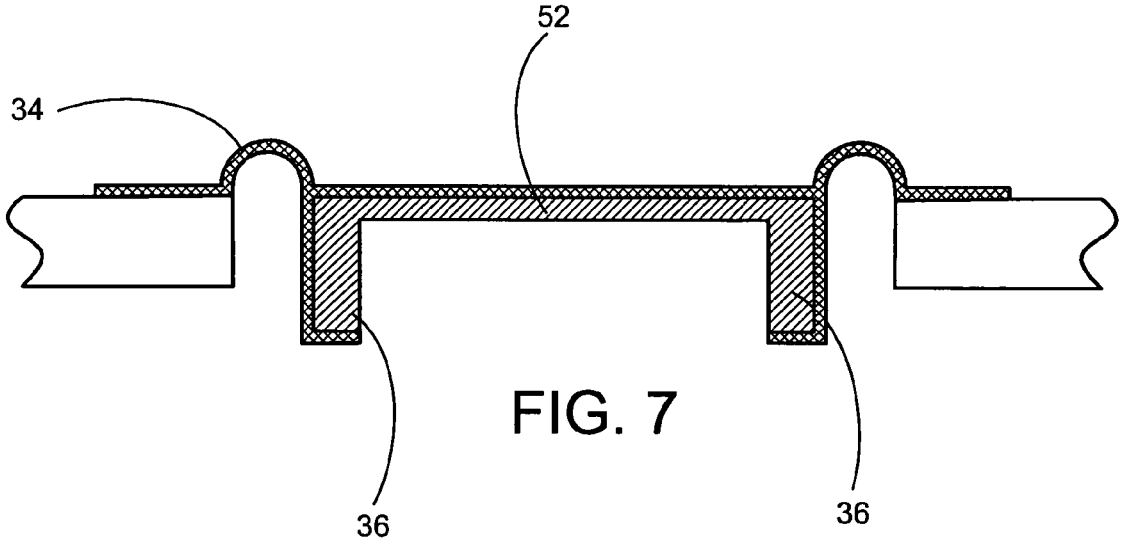
FIG. 7 is a view of a passive radiator diaphragm and surround assembly according to yet another aspect of the invention.
Figure 8:
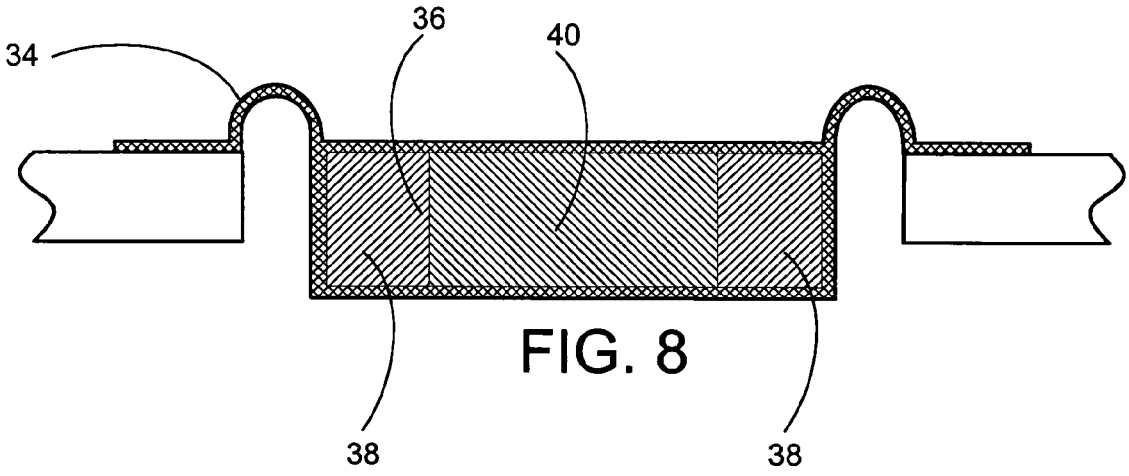
FIG. 8 is a view of an alternate implementation of the passive radiator diaphragm and surround assembly of FIG. 7.

FIGS. 7 and 8 show variations of the implementation of FIGS. 5 and 6. As shown in FIG. 7, the skin element 34 may encase a sufficient portion (for example more than half of the surface area) so that passive radiator can be assembled without adhesive and so that the elements of the passive radiator remain in position, without adhesive, during operation. In other implementations, (as in FIG. 8) the skin element 36 may be completely enclose the mass element 36. In the variation shown in FIG. 7, the mass element is formed to increase the moment of inertia as described above. In the variation shown in FIG. 8, diaphragm has the form of FIG. 6. Since the diaphragm may be sealed, materials such as powders, granular material, liquids, materials that should not be exposed to the environment, and the like can be used for portions of the mass element.

A passive radiator according to FIGS. 7 and 8 can be formed by insert molding. The mass element may be placed in a cavity in a mold. The cavity can then be filled with a flowable, curable material so that it partially or completely encloses the mass element. The flowable, curable material may then be set or cured so that it is suitable form for, and so that is suitably elastomeric for, use as a passive radiator suspension. Suitable materials include thermosettable, thermoplastic, or curable materials such as closed-cell polyurethane foams. Insert molding permits more precise positioning of the mass element 36 relative to the skin element 34 than other manufacturing methods. Because the mass element and the skin element can be more precisely aligned, the passive radiator can be made less prone to rocking mode vibration resulting from misalignment of the passive radiator elements. Additionally, the passive radiator can be formed without the use of adhesives, which eliminates a source of mechanical failure and which eliminates manufacturing steps related to the depositing and curing of adhesives.

The implementations of FIGS. 3A-8 may be combined. For example, a diaphragm assembly may include an unskinned honeycomb portion and a metal portion according to FIG. 6 and a skin element according to FIG. 5; the diaphragm may be thicker at the perimeter according to FIG. 4B or 4C, or both, and have discrete non-surround suspension elements channels according to FIG. 3A. Many other combinations are possible.

The various configurations and geometries may be manufactured in a variety of ways. For example, the implementations of FIG. 4B can be manufactured by metal forming or casting, or may be manufactured by removing material from a slug or metal, plastic, or some other material. The implementation of FIG. 4C could be manufactured by metal forming or casting, or by removing material from or adding material to a slug of metal, plastic, or some other material.

It is evident that those skilled in the art may now make numerous uses of and departures from the specific apparatus and techniques disclosed herein without departing from the inventive concepts. Consequently, the invention is to be construed as embracing each and every novel feature and novel combination of features disclosed herein and limited only by the spirit and scope of the appended claims.

What is claimed is:

1. An acoustic passive radiator, comprising:

a diaphragm for radiating acoustic energy, said diaphragm having a perimeter portion and a central portion, wherein said perimeter portion is thicker than said central portion;

a passive radiator suspension, said suspension including a skin element, said skin element encasing said diaphragm, said skin element comprising a surround for physically coupling said passive radiator to an acoustic enclosure and pneumatically sealing said diaphragm and said enclosure, said surround having a width, wherein said width is non-uniform; and a non-pneumatically sealing, non-surround, non-spider suspension element, wherein said non-surround suspension element and said surround coact to control the motion of said diaphragm and to support the weight of said diaphragm.

2. An acoustic passive radiator, comprising:

a diaphragm for radiating acoustic energy;

a surround for pneumatically sealing said diaphragm and an acoustic enclosure; and a plurality of discrete, non-surround, non-spider suspension elements for physically coupling said diaphragm and said acoustic enclosure, wherein said non-surround suspension elements and said surround coact to control the motion of said diaphragm and to support the weight of said diaphragm.

3. An acoustic passive radiator in accordance with claim 2, wherein said each of said discrete suspension elements comprise a metal band, each of said metal bands having one end constructed and arranged to be attached to said diaphragm and another end constructed and arranged to be attached to said enclosure.

4. An acoustic passive radiator in accordance with claim 2, wherein said plurality of discrete suspension elements and said surround are constructed and arranged to be attached to said diaphragm at a common point.

5. An acoustic passive radiator in accordance with claim 2, wherein said plurality of discrete suspension elements are mechanically attached to said diaphragm at discrete points, and wherein said surround are mechanically attached to said diaphragm along a continuous surface, wherein said continuous surface includes said discrete points.

6. An acoustic passive radiator in accordance with claim 2, wherein said diaphragm is constructed of metal.

7. An acoustic passive radiator in accordance with claim 2, wherein said surround has a non-uniform width.

8. An acoustic passive radiator, comprising:

a diaphragm for radiating acoustic energy by pistonic vibration through an operating frequency range;

a single surround for pneumatically sealing said diaphragm and an acoustic enclosure, wherein said surround is constructed of a solid polyurethane; and a plurality of discrete, non-surround suspension elements, wherein said non-surround suspension elements and said surround coact to control the motion of said diaphragm and to support the weight of said diaphragm.

9. An acoustic passive radiator in accordance with claim 8, wherein said discrete suspension elements comprise a metal band, each of said metal bands having one end constructed and arranged to be attached to said diaphragm and another end constructed and arranged to be attached to said enclosure.

10. An acoustic passive radiator in accordance with claim 8, wherein said plurality of discrete suspension elements and said surround are constructed and arranged to be attached to said diaphragm at a common point.

11. An acoustic passive radiator in accordance with claim 8, wherein said plurality of discrete suspension elements are mechanically attached to said diaphragm at discrete points, and wherein said surround are mechanically attached to said diaphragm along a continuous surface, wherein said continuous surface includes said discrete points.

12. An acoustic passive radiator in accordance with claim 8, wherein said diaphragm has a non-uniform width.

13. An acoustic passive radiator, comprising a diaphragm for radiating acoustic energy;

a surround for pneumatically sealing said diaphragm and an acoustic enclosure, wherein said surround comprises a single element and has a non-uniform width; and a plurality of discrete, non-surround suspension elements, wherein said discrete suspension elements and said surround coact to control the motion of said diaphragm and to support the weight of said diaphragm.

14. An acoustic passive radiator in accordance with claim 13, wherein said discrete suspension elements comprise a metal band, each of said metal bands having one end constructed and arranged to be attached to said diaphragm and another end constructed and arranged to be attached to said enclosure.

15. An acoustic passive radiator in accordance with claim 13, wherein said plurality of discrete suspension elements and said surround are constructed and arranged to be attached to said diaphragm at a common point.

16. An acoustic passive radiator in accordance with claim 13, wherein said plurality of discrete suspension elements are mechanically attached to said diaphragm at discrete points, and wherein said surround are mechanically attached to said diaphragm along a continuous surface, wherein said continuous surface includes said discrete points.

* * * * *

UNITED STATES PATENT AND TRADEMARK OFFICE

CERTIFICATE OF CORRECTION

PATENT NO. : 7,568,552 B2
APPLICATION NO. : 10/758336
DATED : August 4, 2009
INVENTOR(S) : Litovsky et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1308 days.

Signed and Sealed this

Seventh Day of September, 2010

David J. Kappos

David J. Kappos
*Director of the United States Patent and Trademark Office*